United States Patent [19]

Nicolas et al.

[11] 4,243,497

[45] Jan. 6, 1981

[54] PROCESS FOR THE ELECTROLYTIC PRODUCTION OF HYDROGEN IN AN ALKALINE

[75] Inventors: Edgard Nicolas; Louis Bourgeois, both of Brussels, Belgium

[73] Assignee: Solvay & Cie., Brussels, Belgium

[21] Appl. No.: 68,521

[22] Filed: Aug. 22, 1979

[30] Foreign Application Priority Data

Aug. 24, 1978 [FR] France ..... 78 24757

[51] Int. Cl.[3] ..... C25B 1/04; C25B 1/34; C25B 11/04

[52] U.S. Cl. ..... 204/98; 204/128; 204/129; 204/290 F; 204/290 R; 427/34

[58] Field of Search ..... 204/290 F, 290 L, 98, 204/128, 129

[56] References Cited

U.S. PATENT DOCUMENTS

| | | | |
|---|---|---|---|
| 3,711,382 | 1/1973 | Anthony | 204/290 L |
| 3,711,397 | 1/1973 | Martinsons | 204/290 F |

FOREIGN PATENT DOCUMENTS

| | | | |
|---|---|---|---|
| 2734879 | 4/1978 | Fed. Rep. of Germany | 204/290 F |

*Primary Examiner*—R. L. Andrews

*Attorney, Agent, or Firm*—Robert E. Burns; Emmanuel J. Lobato; Bruce L. Adams

[57] ABSTRACT

The invention relates to a process for the electrolytic production of hydrogen in an alkaline medium.

The process consists in using a cathode, the active surface of which essentially consists of an oxide compound of the spinel type.

The process is suitable, in particular, for the electrolysis of aqueous solutions of sodium chloride in cells with a permeable diaphragm.

9 Claims, No Drawings

PROCESS FOR THE ELECTROLYTIC PRODUCTION OF HYDROGEN IN AN ALKALINE

The present invention relates to a process for the electrolytic production of hydrogen in an alkaline medium, in which process the hydrogen is liberated at the active surface of a cathode.

In electrolysis processes, it is generally desired to reduce the potentials of the electrochemical reactions at the electrodes to as low a value as possible. This is the case in particular in electrolysis processes in which gaseous hydrogen is produced at the active surface of a cathode, such as processes for the electrolysis of water, of aqueous solutions of hydrochloric acid and of aqueous solutions of sodium chloride.

The cathodes hitherto used in practice for the electrolysis of water or of sodium chloride have generally consisted of plates or gauzes made of mild steel.

Thus, in German Patent Application No. 2,734,879, filed on Aug. 3, 1977 in the name of the State of Israel and published on Apr. 13, 1978, it is proposed to make electrodes from materials catalysing the decomposition of hydrogen peroxide, which materials consist of mixed oxides having the spinel structure and containing boron. This patent application points out that such materials are also suitable for the electrolytic production of gaseous hydrogen in an alkaline medium.

The incorporation of boron into such materials constitutes a difficult and expensive operation requiring a treatment at a very high temperature which is generally of the order of 900° C. The cathodes, especially when they consist of thin plates or gauzes, cannot easily withstand such high temperatures without suffering local deformations which detract from the satisfactory functioning of the electrolysis cells.

The object of the present invention is to produce hydrogen in an alkaline medium by liberation at the surface of cathodes, the manufacture of which does not exhibit the disadvantages of that of the cathodes described above, and which possess properties, in particular an overvoltage on the liberation of hydrogen, which are as favourable as those of the abovementioned cathodes. Furthermore, the cathodes used according to the invention have a particularly favourable service time.

The invention therefore relates to a process for the electrolytic production of hydrogen in an alkaline medium, in which process the hydrogen is liberated in the gaseous form at the active surface of a cathode, and in which the cathode employed has an active surface which essentially consists of oxide compounds of the spinel type.

In fact, it has been found that, when used for forming the active surface of a cathode for the electrolytic production of hydrogen in an alkaline medium, the oxide compounds of the spinel type which are free from boron exhibit, all other things being equal, an overvoltage, on the liberation of hydrogen, which is at least comparable to, and sometimes even less than, the overvoltage of these same oxide compounds containing boron, which are proposed in the abovementioned German Patent Application No. 2,734,879.

In accordance with the definition which is generally given thereof in the literature (Structural Inorganic Chemistry—A. F. Wells—Oxford University Press—1962—pages 487 to 490; Crystal Structures of Minerals—Bragg and Claringbull—Bell and Sons Ltd—1965—pages 102 to 106), the oxide compounds of the spinel type, used according to the invention, are inorganic compounds of the general formula $M^{II}M^{III}{}_2O_4$, in which $M^{II}$ denotes a divalent metallic element or several divalent metallic elements and $M^{III}$ denotes a trivalent metallic element or several trivalent metallic elements. These oxide compounds generally adopt the crystallographic structure of spinel itself, namely $MgAl_2O_4$. These oxide compounds of the spinel type possess a crystal cell which is characterised by a compact cubic array of 32 oxygen atoms; the distribution of the atoms of the metals $M^{II}$ and $M^{III}$ in the cell is such that 8 metal atoms are arranged at the centres of 8 tetrahedra, the apices of which are occupied by 4 oxygen atoms, and 16 other metal atoms are arranged at the centres of 16 octahedra, the apices of which are occupied by 6 oxygen atoms. The oxide compounds of the spinel type can be divided into two distinct groups.

In one of these groups, referred to as the group of normal structure, the 8 metal atoms which occupy the centres of the 8 tetrahedra are all atoms of the divalent metal $M^{II}$, the 16 other metal atoms all being atoms of the trivalent metal $M^{III}$. The oxide compounds of the general formulae $M^{II}Al_2O_4$ (in which $M^{II}$ denotes Mg, Mn, Fe, Co or Zn), $M^{II}Cr_2O_4$ (in which $M^{II}$ denotes Mg, Mn, Fe, Co, Ni, Cu or Zn), $ZnFe_2O_4$, $Mn_3O_4$ and $Co_3O_4$ all belong to this group of normal structure.

In the other group, referred to as the group of inverse structure, it is 8 atoms of the trivalent metal $M^{III}$ which occupy the centres of the eight tetrahedra, half of the centres of the 16 octahedra being occupied by the remaining 8 atoms of the trivalent metal $M^{III}$ and half being occupied by the 8 atoms of the divalent metal $M^{II}$. The compounds of the general formula $M^{II}Fe_2O_4$, in which $M^{II}$ denotes a divalent metal chosen from amongst Mg, Fe, Co, Ni and Cu, generally belong to this group of inverse structure.

According to the invention, it is of no consequence whether the compounds used are oxide compounds of normal structure, oxide compounds of inverse structure or oxide compounds which possess a structure intermediate between the normal structure and the inverse structure, such as, for example, the compound of the general formula $NiAl_2O_4$, in which about 38% of the aluminium atoms occupy the centres of tetrahedra.

Examples of oxide compounds which are very suitable for use according to the invention are those of the general formula $M^{II}M^{III}{}_2O_4$, in which $M^{II}$ denotes a divalent metal or several divalent metals chosen from amongst iron, zinc, manganese, nickel, cobalt, magnesium, cadmium and copper, and in which $M^{III}$ denotes a trivalent metal or several trivalent metals chosen from amongst aluminium, iron, chromium, manganese, vanadium, titanium, cobalt and gallium.

According to the invention, it is preferred to use oxide compounds which contain a metal $M^{III}$ chosen from amongst iron, chromium, manganese, nickel and cobalt, and, more particularly, compounds of the general formula $M^{II}M^{III}{}_2O_4$, in which $M^{II}$ and $M^{III}$ are identical, the metal being respectively in the divalent and trivalent state. Magnetite, of the general formula $Fe_3O_4$ (or $Fe^{II}Fe^{III}{}_2O_4$), is the compound which leads to the best results when the cathodes are used in the presence of aqueous solutions of an alkali metal hydroxide, such as the caustic alkali solutions and the caustic brines obtained by the electrolysis of sodium chloride brines, respectively in electrolysis cells with a membrane of selective permeability and in electrolysis cells with a permeable diaphragm.

The term membrane of selective permeability is understood as meaning a non-porous thin separator which separates the anodes from the cathodes and comprises an ion exchange material. Examples of membranes of selective permeability suitable for cells for the electrolysis of brine include cationic membranes which contain groups $SO_3^-$ and result from the copolymerisation of tetrafluoroethylene and sulphonated perfluorovinyl ether, such as the membranes known under the name NAFION and sold by E. I. du Pont de Nemours & Co.

The term diaphragm is understood as meaning a partition which is permeable to the electrolyte, is made of an inert material and separates the anodes from the cathodes. Examples of known diaphragms include asbestos diaphragms, such as those described in U.S. Pat. No. 1,855,497 of May 7, 1928, by Stuart, and Belgian Pat. No. 773,918 of Oct. 14, 1971, in the name of the Applicant Company, porous sheets formed by a mixture of asbestos and a polyelectrolyte, such as those described and claimed in Luxembourg Pat. No. 74,835 of Apr. 26, 1976, in the name of the Applicant Company, and porous sheets of polytetrafluoroethylene, such as those described in Belgian Pat. Nos. 794,889 of Feb. 2, 1973 and 817,675, 817,676 and 817,677 of July 15, 1974, in the name of Imperial Chemical Industries Limited.

In addition to the oxide compounds of the spinel type, the active surface of the cathodes used according to the invention can contain foreign substances, for example in the form of traces, provided that these substances do not affect those properties of the oxide compounds which are essential for the process according to the invention.

Any technique which is in itself known can be used for manufacturing the cathodes used according to the invention. For example, the latter can consist of massive blocks obtained by fritting a powder of the oxide compound.

In a particular embodiment, it is possible to use a cathode consisting of a metal support, for example a metal plate, which carries the oxide compound on at least part of its surface. The metal support can be made of any metal or alloy which withstands the chemical and/or thermal conditions to which the cathode is subjected. In the particular case where the cathode is intended to equip a cell with a permeable diaphragm or with a membrane of selective permeability, for the electrolysis of aqueous solutions of alkali metal halides, the metal support advantageously consists of a steel plate, generally a perforated plate. The perforated plate can, for example, have an essentially plane profile in the case of a cathode intended for equipping a cell of the type of those described, by way of examples, in French Pat. Nos. 2,164,623 of Dec. 12, 1972 and 2,230,411 of Mar. 27, 1974, in the name of the Applicant Company.

As a variant, the perforated plate can have an undulated profile in the case where the cathode is intended for an electrolysis cell of the type of those described, by way of examples, in French Pat. Nos. 2,223,083 of Mar. 28, 1973 and 2,248,335 of Oct. 14, 1974, in the name of the Applicant Company.

Any technique which is in itself known can be used for forming the oxide compound on the metal support or for applying it thereto. In the case of a compound of the general formula $M_3O_4$, such as magnetite, it is possible to use a support made of this metal M and to heat it on the surface in a controlled oxidising atmosphere, for example in an oven or in contact with an oxidising flame.

It is also possible, as a variant, to disperse a powder of the oxide compound in a suitable liquid containing a binder, and to apply one or more layers of the resulting liquid suspension to the support, for example by coating, dipping or spraying, and then, if appropriate, subsequently to heat the coated support in order to melt the binder and to coat the particles of the oxide compound therewith.

However, it is preferred to apply the oxide compound to the metal support by a technique of spraying in a jet of plasma. For this purpose, various different procedures are possible. In particular, the oxide compound, in the finely divided state in the jet of plasma, can be sprayed directly, in an inert atmosphere such as an argon atmosphere.

As a variant, it is also possible to spray the metal or metals forming part of the composition of the oxide compound, in the finely divided state in a jet of plasma, in a controlled oxidising atmosphere.

According to another variant of the technique of spraying using plasma, the metal or metals forming part of the composition of the oxide compound, in the finely divided state in a jet of plasma, are sprayed, in an inert atmosphere (for example argon), and the support coated in this way is then heated in a controlled oxidising atmosphere in order to form the oxide compound thereon.

The layer of the oxide compound on the metal support is generally sufficiently thick to resist wear by abrasion in contact with the gaseous hydrogen and the electrolytes which circulate in contact therewith during the electrolysis. In general terms, it is desirable for the thickness of the layer of the oxide compound on the metal support to be at least 0.5 micron, preferably at least 5 microns. In the case where the layer is obtained by spraying a metal in a jet of plasma, as described above, good results are obtained with a thickness of the order of about 100 microns.

The invention finds a particularly valuable application in cells with a permeable diaphragm and with a membrane of selective permeability, for the electrolysis of sodium chloride brines, such as those cells described, by way of examples, in French Pat. Nos. 2,164,623 of Dec. 12, 1972, 2,223,083 of Mar. 28, 1973, 2,230,411 of Mar. 27, 1974 and 2,248,335 of Oct. 14, 1974, and in French Patent Application 77/11,370 of Apr. 12, 1977, all in the name of the Applicant Company.

The value of the invention will become apparent from the description of the following application examples which are given exclusively by way of illustration.

In each of the examples which now follow, an aqueous brine, containing 255 g of sodium chloride per kg, was electrolysed in a laboratory cell with vertical electrodes separated by an asbestos diaphragm.

The cell, of cylindrical shape, comprised an anode formed by a circular titanium plate, which was pierced with vertical slots and coated with an active material comprising mixed crystals consisting of 50% by weight of ruthenium dioxide and 50% by weight of titanium dioxide.

The cathode consisted of a circular metal structure in the form of a gauze, the shape of which was identical in every example, but the constitution of which varied from one example to the other.

The overall surface area of each electrode of the cell was equal to 113 $cm^2$ and the distance between the anode and the cathode was fixed at 5 mm.

The diaphragm was applied to that face of the cathode which was oriented towards the anode, from a suspension of asbestos in a caustic brine, and then heated for 16 hours at 90° C., applying the technique described in Luxembourg Patent Application 77,996 of Aug. 19, 1977, in the name of the Applicant Company. The weight of the resulting diaphragm was 1.3 kg/m$^2$ of cathode.

In each example, the abovementioned brine was electrolysed in the cell, at 85° C., under a current density of 2 kA per square meter of anode, and the flow rate of brine introduced into the anode compartment was adjusted so that the caustic brine leaving the cathode compartment contained about 100 g of sodium hydroxide and 140 g of sodium chloride per kg. The potential of the cathode was measured periodically, by means of Luggin's capillary measurement method, relative to a saturated calomel reference electrode (SCE) (Modern Electrochemistry, Bockris and Reddy, Plenum Press, 1970, Volume 2, pages 890 and 891).

EXAMPLE 1

The cathode consisted of a mild steel gauze which, successively, was cleaned with hydrochloric acid passivated with formaldehyde, and then heated to 750° C. in contact with an oxidising flame produced by a laboratory Bunsen burner fed with Brussels town gas. The treatment was continued for a sufficient time to form an approximately 10 micron thick layer of magnetite on the surface of the steel gauze.

The change, during the electrolysis, of the cathodic potential of the cathode thus obtained has been recorded in Table I.

TABLE I

| Duration of the electrolysis (days) | Cathodic potential (V/SCE) |
|---|---|
| 3 | −1.26 |
| 40 | −1.26 |
| 70 | −1.26 |
| 120 | −1.26 |

EXAMPLE 2

In the present experiment, the cathode used consisted of a mild steel gauze, identical to that in the experiment of Example 1, which, successively, was cleaned with hydrochloric acid passivated with formaldehyde, and then coated with a layer of magnetite by spraying a magnetite powder in a jet of plasma, in an inert atmosphere. The mean diameter of the particles of the magnetite powder was about 8 microns and the amount of magnetite employed was adjusted so as to give an approximately 250 micron coating of magnetite on the cathode.

The change in the potential of the cathode during the electrolysis has been given in Table II.

TABLE II

| Duration of the electrolysis (days) | Cathodic potential (V/SCE) |
|---|---|
| 3 | −1.25 |
| 40 | −1.25 |
| 70 | −1.25 |
| 90 | −1.25 |

EXAMPLE 3

In this experiment, a mild steel gauze, identical to that of the preceding examples, which was cleaned with hydrochloric acid passivated with formaldehyde, was used to manufacture the cathode. The cleaned gauze was then coated with ten successive layers of mixed crystals of nickel oxide and cobalt oxide, having the spinel structure, of the general formula $NiCo_2O_4$. To apply each of the layers, the gauze, heated to 250° C. beforehand, was immersed in a solution containing nickel nitrate (0.1 mol/liter) and cobalt nitrate (0.2 mol/liter) in butanol, and then heated in air for 10 minutes at 250° C. After the application of the tenth layer of the coating, the coated gauze was heated in air for 16 hours at 350° C. and then cooled to ambient temperature.

The change, during the electrolysis, of the cathode thus obtained has been recorded in Table III.

TABLE III

| Duration of the electrolysis (days) | Cathodic potential (V/SCE) |
|---|---|
| 3 | −1.29 |
| 10 | −1.30 |
| 20 | −1.34 |

EXAMPLE 4

By way of comparison, a cathode preceding the invention was used, which consisted of a mild steel gauze, identical to that of Examples 1 and 2, which was only cleaned by treatment with hydrochloric acid passivated with formaldehyde, and then mounted as such in the cell.

Table IV gives the change in the potential of the cathode during the electrolysis.

TABLE IV

| Duration of the electrolysis (days) | Cathodic potential (V/SCE) |
|---|---|
| 3 | −1.41 |
| 40 | −1.41 |
| 70 | −1.45 |

A comparison of the results of Examples 1, 2 and 3 (according to the invention) with those of Example 4 (preceding the invention) immediately shows the improvement provided by the invention in terms of the energy efficiency of the electrolysis cells.

We claim:

1. Process for the electrolytic production of hydrogen in an alkaline medium, in which process hydrogen is liberated in the gaseous form at the active surface of a cathode, characterised in that the cathode employed has an active surface which essentially consists of oxide compounds of the spinel type.

2. Process according to claim 1, characterised in that the oxide compound corresponds to the formula $M^{II}M^{III}{}_2O_4$, in which the divalent metal $M^{II}$ is chosen from amongst iron, zinc, manganese, nickel, cobalt, magnesium, cadmium and copper, and the trivalent metal $M^{III}$ is chosen from amongst iron, chromium, manganese, nickel and cobalt.

3. Process according to claim 2, characterised in that the divalent metal $M^{II}$ and the trivalent metal $M^{III}$ are identical.

4. Process according to claim 3, characterised in that the oxide compound is magnetite.

5. Process according to any one of claims 1 to 4, characterised in that a cathode in which the oxide compound is applied to a metal support is employed.

6. Process according to claim 5, characterised in that the metal support is a perforated plate.

7. Process according to claim 5 characterised in that the oxide compound is a compound obtained by spraying metal, in a jet of plasma, onto the metal support in an oxidising atmosphere.

8. Process according to claim 5, characterised in that the thickness of the layer of oxide compound is equal to at least 5 microns.

9. Process according to any one of claims 1 to 4, characterised in that it is applied to the electrolysis of aqueous solutions of alkali metal halides.

* * * * *